US011238712B1

(12) United States Patent
Dickson

(10) Patent No.: US 11,238,712 B1
(45) Date of Patent: Feb. 1, 2022

(54) SENTRY POLE

(71) Applicant: Bryan Buford Dickson, Maitland, FL (US)

(72) Inventor: Bryan Buford Dickson, Maitland, FL (US)

( * ) Notice: Subject to any disclaimer, the term of this patent is extended or adjusted under 35 U.S.C. 154(b) by 0 days.

(21) Appl. No.: 17/216,433

(22) Filed: Mar. 29, 2021

(51) Int. Cl.
*G08B 13/00* (2006.01)
*G08B 15/00* (2006.01)
*G08B 7/06* (2006.01)

(52) U.S. Cl.
CPC ..... *G08B 13/00* (2013.01); *G08B 7/06* (2013.01); *G08B 15/00* (2013.01)

(58) Field of Classification Search
CPC ..... G08B 13/00; G08B 15/00; G08B 7/06
See application file for complete search history.

(56) References Cited

U.S. PATENT DOCUMENTS 3,599,201 A * 8/1971 Clardy ..... G08B 7/06 340/326
4,922,224 A * 5/1990 Drori ..... B60R 25/1004 340/426.25
5,463,595 A * 10/1995 Rodhall ..... A01M 29/18 340/426.23
5,740,645 A * 4/1998 Raby ..... E02D 27/42 248/346.5
2009/0289790 A1* 11/2009 Issokson ..... G08B 13/189 340/552
2020/0118054 A1* 4/2020 Bayges ..... H04B 17/318

OTHER PUBLICATIONS

Belle of Dirt, Mailbox recycle, Jun. 8, 2015 (Year: 2015).*

* cited by examiner

*Primary Examiner* — Brian Wilson

(57) ABSTRACT

A signaling pole assembly includes an elongated structure that provides both audible and visual notification when a remote sensor has been triggered. The elongated structure has a base assembly end configured to be buried underground and a cap end that is located opposite the base end. Lights and sirens are positioned on the elongated body near the cap end. A receiver module is positioned on the elongated body above the surface of the ground. The receiver module further comprising circuitry configured for receiving signals when a remote sensor has been triggered causing the lights and sirens to activate and return to standby operation after a predetermined amount of time has elapsed.

10 Claims, 4 Drawing Sheets

SENTRY POLE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The field of endeavor for the present disclosure is generally directed to signaling systems and related methods, and more particularly to audible and visible signaling through the use of sound and light sources.

Burglary, theft and other unauthorized access by intruders is an ongoing problem for gated communities. Residential gated communities often have intruders breach the perimeter wall and commit crimes while inside the neighborhood. Many communities have attempted to mitigate the problem by use of alarm systems and security cameras. The problem is that alarm systems are generally triggered after an intruder has broken into a home or vehicle and security cameras capture footage of the event after it has already occurred.

Accordingly, there is a need for a signaling device that provides audible and visible signaling through the use of sound and light sources for purposes of deterring crime.

BRIEF SUMMARY

An aspect of the present disclosure is to provide a signaling pole assembly that may be added as an accessory part to a perimeter security system or other alarm system for purposes of scaring away an intruder by alerting them that they have been detected near a point of entry along a perimeter boundary or other restricted area. The signaling pole assembly comprising an elongated body that is rigid and hollow, a base assembly, a weatherproof cap, a receiver module, at least one light and at least one siren. The base assembly further comprising a portable container, conduit and poured concrete. The receiver module further comprising circuitry configured for receiving signals when a remote sensor has been triggered causing the lights and sirens to activate and then return to standby operation after a predetermined amount of time has elapsed.

Another aspect of the present disclosure is to provide a base assembly for securing the exposed portion of the elongated body in a upright position and for providing concealed access to underground power through conduit secured by poured concrete. The base assembly can be buried underground for semi-permanent placement, can be assembled in advance for quick deployment and can be used on a variety of terrain. The base assembly comprising a portable container, conduit and poured concrete. The portable container can be any number of commercially available buckets or pails, preferably a standard five-gallon bucket.

An advantage of the present disclosure is that the signaling pole assembly can be added as an accessory part to a variety of existing perimeter security systems or other alarm systems to notify an intruder they have been detected near a point of entry of a predetermined area, such as a perimeter boundary, for purposes of scaring them away before a crime is committed.

An additional advantage of the present disclosure is that after installation the signaling pole assembly is not portable providing semi-permanent placement for use along a perimeter boundary or other restricted area so that residents, lawn maintenance crews or others would not be able to push it aside or move it from the installed location.

Another advantage of the present disclosure is the ability to connect wirelessly to a variety of sensors that are not physically located on the signaling pole assembly providing alternatives for customizing the application and use.

An added advantage of the present disclosure is the base assembly provides for quick deployment of the signaling pole assembly which can be moved to accommodate changing perimeter boundaries within an area of wireless reception.

An extra advantage of the present disclosure is that it can be installed in various elevations, range and terrain along a perimeter boundary. The base assembly secures the exposed upright portion of the elongated body so that it can be installed on inclines and is not limited to use on horizontal surfaces.

A supplementary advantage of the present disclosure is that the base assembly provides concealed access to underground power through the conduit pathway which enhances safety, prevents tampering and provides a clean appearance without exposed wires. In addition to underground utilities, solar, battery and other power sources may also be used.

One more advantage of the present disclosure is that the signaling pole assembly provides a mounting platform for receiving any variety of security devices or additional accessories such as security cameras, battery backups, memory modules, communication modules or other equipment.

BRIEF DESCRIPTION OF THE SEVERAL VIEWS OF THE DRAWING

This device may be more clearly understood with the following detailed description and by reference to the drawings in which.

DETAILED DESCRIPTION

The detailed description below in connection with the appended drawings is intended as a description of the presently preferred embodiments of a signaling pole assembly or sentry pole in accordance with aspects of the present device and is not intended to represent the only forms in which the present devices and methods may be constructed or utilized. The description sets forth the features and the steps for constructing and using the embodiments of the present device and methods in connection with the illustrated embodiments.

As used herein, the terms "vertical," "upright," "upright position" and similar terms, are understood to be with reference to the ground. Similarly, the terms "top," "bottom," "above," and "below" indicate positions relative to a given point or element. For example, the top of the sentry pole is at a higher altitude or height than a bottom of a sentry pole and therefore, the top, elevation-wise, is located above the bottom of the sentry pole.

Figure 1:
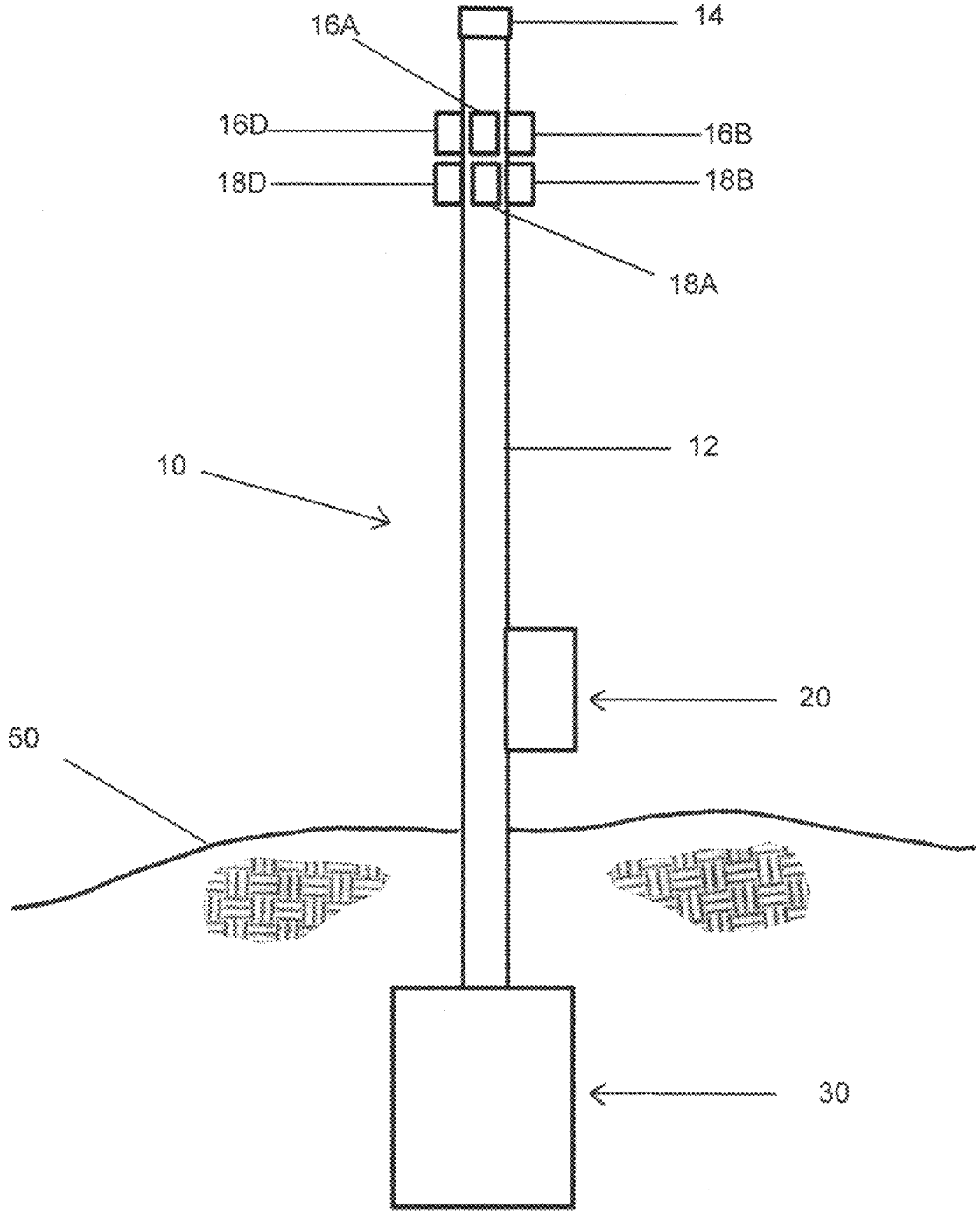
FIG. 1 is the schematic front elevation view of a signaling pole assembly embodying the device.
Figure 2:
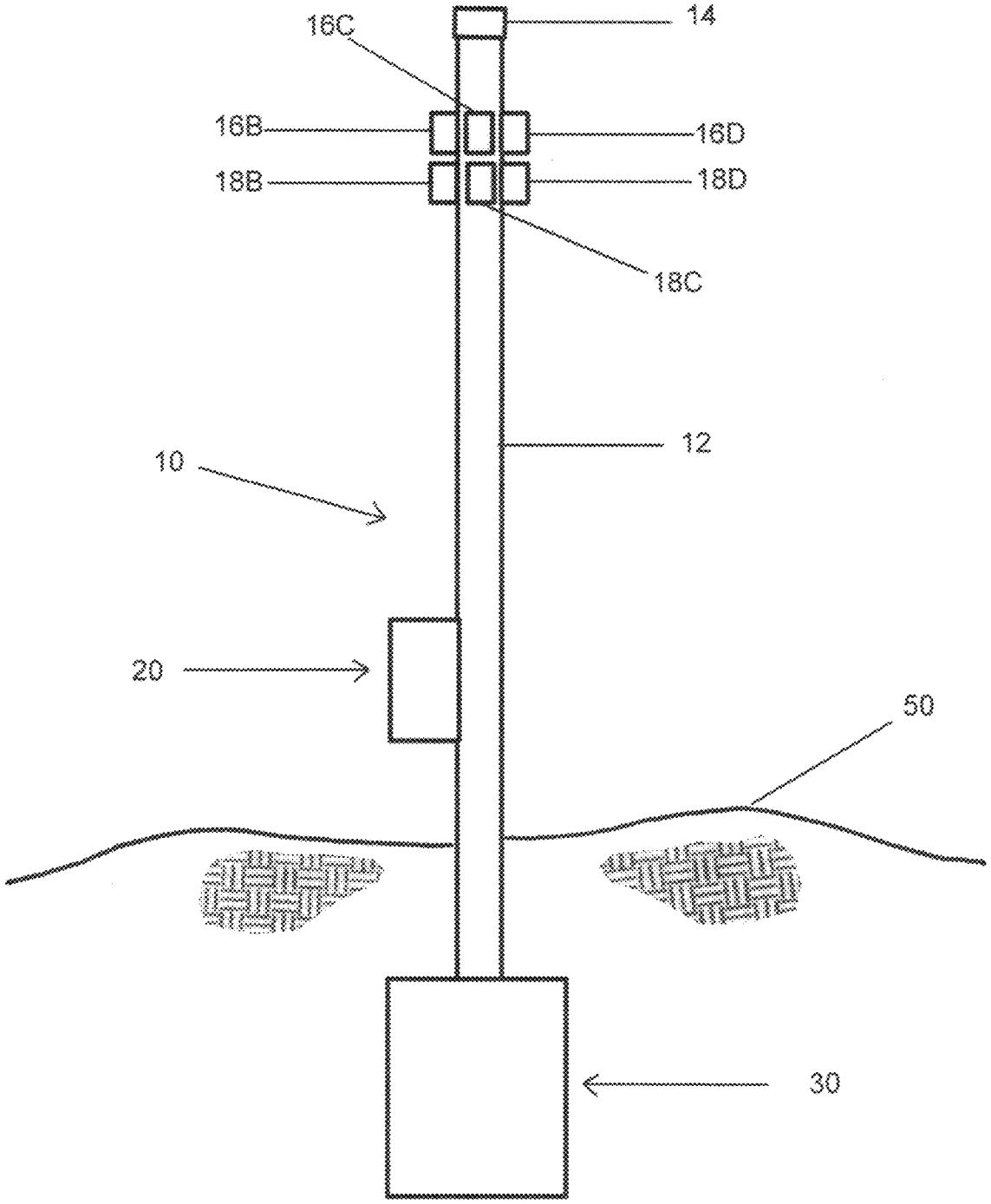
FIG. 2 is the schematic back elevation view of a signaling pole assembly embodying the device.

In FIGS. 1&2 are schematic front and back elevation views, respectively, of a signaling pole assembly or sentry pole 10. The sentry pole 10 comprising an elongated body, pole or post 12 that is rigid and hollow; a weather proof removable cap 14 to seal the top of post 12 from environmental elements and to provide service entry access; at least one light 16A-D positioned near the top of the post 12; at least one siren 18A-D positioned near the top of the post 12; a receiver module 20 (see FIG. 3) attached to the post 12 in a predetermined position above the surface of the ground 50; and a base assembly 30 (see FIG. 4) to be buried a predetermined depth under the surface of the ground 50.

Post 12 can have a varying overall length that is customized based on the application. The portion of the length of the post 12 fixed under the surface of the ground 50 after installation can be considered the base portion and the remaining portion of the length of the post can be considered the upright portion.

The shape of post 12 can be in the form of a hollow elongated body with or without taper. Preferably, in cross-section, the post 12 is square in shape. If tapered, the post 12 can have a decreasing circumference in a direction from the base portion to the upright portion. The post 12 may also embody a number of different shapes and designs, such as a triangular structure and can be multi-sided or polygonal, in cross-section. In one example, post 12 is comprised of commercially available 12' hollow 4"×4" post made of aluminum that is, in cross section, square shaped to provide a flat surface on each side of post 12 for mounting the lights 16A-D, the sirens 18A-D and the receiver module 20 (see FIG. 3).

The post 12 may be made of a single homogenous material with substantially the same properties throughout the post 12, or formed with different material properties throughout the post. The post 12 can be made of a homogenous material such a metal, wood, concrete or a composite material comprising any combination of materials.

The upright portion of post 12 can extend up a few feet to twelve feet or more up from the surface of the ground 50. The base portion can extend a few feet to six feet or more into the ground 50 or soil to support the weight of the sentry pole 10 in an upright position.

The weather proof removable cap 14, preferably a cast metal cap made of aluminum, seals the top of the post 12 from environmental elements, provides service entry access and can be secured to the post 12 with anti-tampering security screws or other fastening materials to prevent damage, tampering or other unauthorized changes to the sentry pole 10.

At least one light 16A-D, preferably comprising four all weather Department of Transportation (DOT) approved LED wide dispersion strobe lights, mounted near the top of post 12 and mounted one light 16A-D on each side of post 12 so that the lights 16A-D can be seen from any direction.

At least one light 16A-D, preferably comprising a combination of red and blue lights to simulate police lights. The lights 16A-D can comprise a variety of high luminance strobe lights and can comprise any combination of colors. The lights 16A-D can have any number of different flash patterns, including but not limited to, steady burn, single flash, triple flash, quad flash or random flash.

At least one siren 18A-D, preferably comprising four loud, high pitched sirens, mounted near the top of post 12 and mounted one siren 18A-D on each side of post 12 so that the sirens 18A-D can be heard from any direction. The sirens 18A-D may comprise an annunciator type siren to sound an audible notification to vacate the area or other verbal message.

Figure 3:
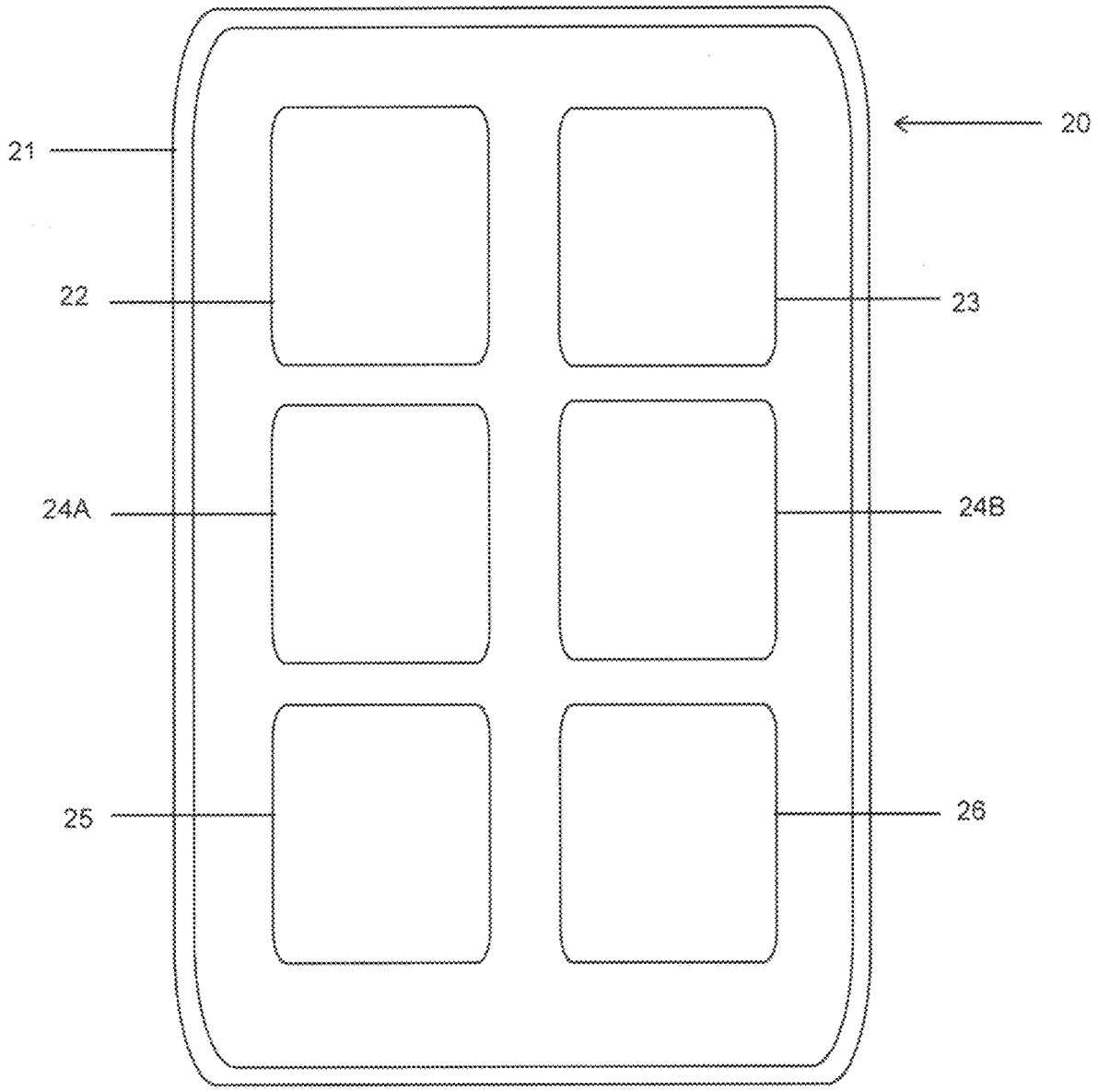
FIG. 3 is an enlarged schematic view of the receiver module showing the arrangement of components therein.

In FIG. 3, is an enlarged schematic view of the receiver module 20 showing the arrangement of components therein. Receiver module 20 comprises one housing or all-weather outdoor enclosure 21 to house and protect the circuitry from the environmental elements, a 110V outdoor rated ground fault interrupter (GFI) outlet 22, a multi-outlet surge and lightning protection device 23, two power supplies 24A and 24B that can convert 110 AC to DC power ranging from 12 to 16 volts DC, a wireless radio receiver 25, and a programmable event relay controller with timer 26.

In one example, the enclosure 21 may be a clamshell type housing with a seal around the perimeter of an opening of one clamshell half so that when the two clamshell halves are joined together to close, the seal prevents moisture from entering into an interior cavity of the enclosure 21. The material of the enclosure 21 may be other than plastic, such as metal or other material as long as communication can be established with wireless radio receiver 25.

The 110V outdoor rated ground fault interrupter (GFI) outlet 22 is connected to underground power, solar power or another power source; the multi-outlet surge and lightning protection device 23 is connected to the 110V outdoor rated ground fault interrupter (GFI) outlet 22; the two power supplies 24A and 24B are connected to the multi-outlet surge and lightning protection device 23; the wireless radio receiver 25 is connected to first power supply 24A and the programmable event relay controller with timer 26 is connected to the second power supply 24B.

Figure 4:
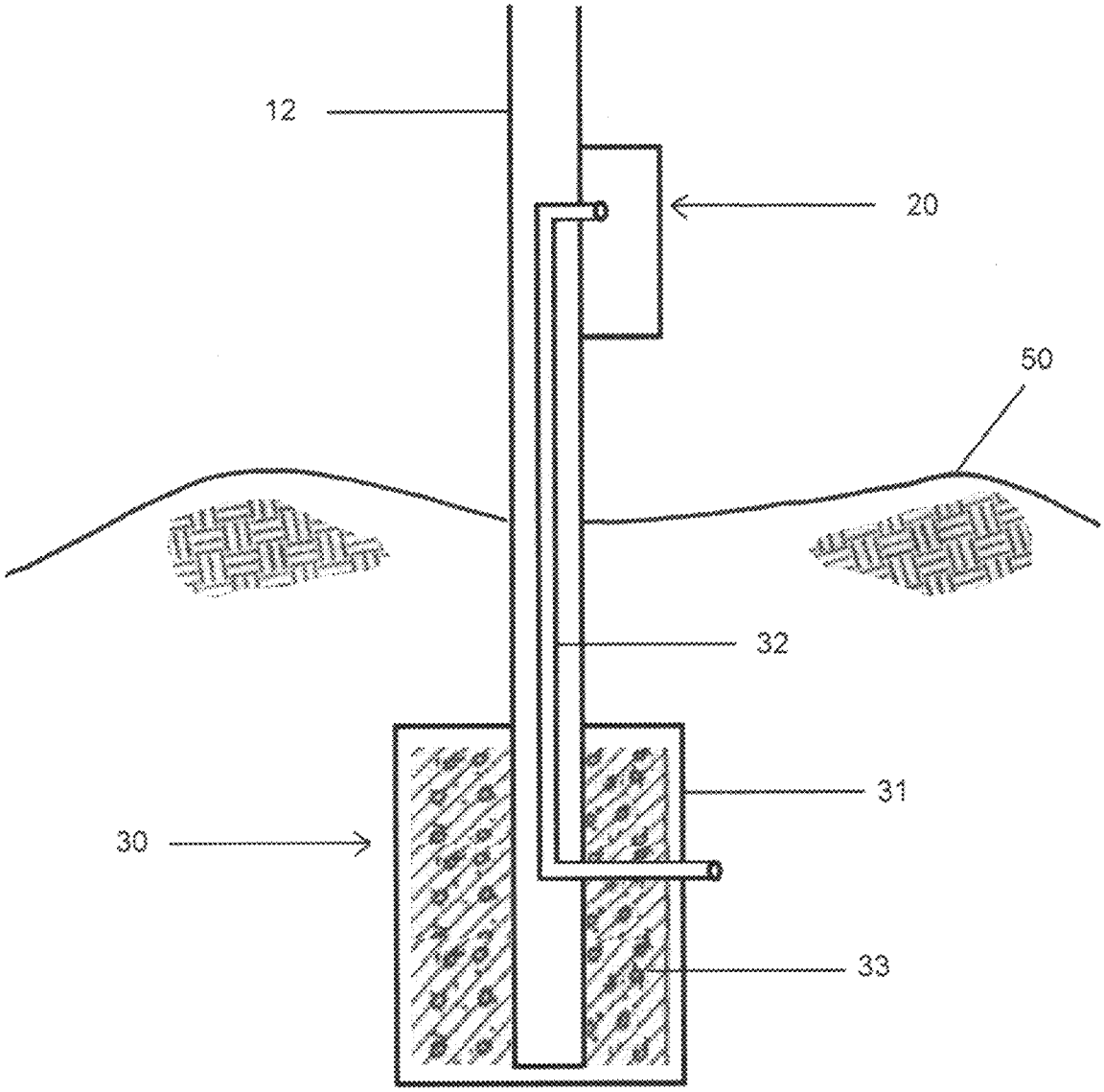
FIG. 4 is an enlarged schematic internal section view of the base assembly showing the arrangement of components therein.

In FIG. 4, is an enlarged schematic internal section view of the base assembly 30 showing the arrangement of components therein. Base assembly 30 for securing the exposed above ground 50 portion of post 12 in an upright position and for providing concealed access to underground power through the conduit 32 pathway. The base assembly 30 comprising a bucket, pail or other portable container 31, conduit 32 preferably comprising % or 1" non-metallic in ground PVC which is to be secured in place by poured concrete 33. The portable container 31 can be any number of commercially available buckets or pails, preferably a standard five-gallon bucket.

With reference to FIG. 4, the base assembly 30 is constructed by placing post 12 in an upright position inside portable container 31. A first opening can be formed passing through the side of the portable container 31, through the side of post 12 and into the hollow center of post 12. A second opening can be formed on hollow post 12 in a spaced apart relationship such that the second opening would be situated above ground 50 after installation of sentry pole 10. A predetermined length of conduit 32 is run through the first opening in portable container 31, into the center of the hollow post 12, up through hollow post 12 and out of the second opening in hollow post 12 forming a conduit 32 pathway. The portable container containing post 12 and conduit 32 is then filled with poured concrete 33 to secure post 12 in an upright position and provide a conduit 32 pathway for access to underground utilities or other power source.

With reference to FIG. 3, the receiver module 20 is constructed by connecting enclosure 21 to the post 12 at a position on the post 12 covering the second opening situated above the surface of the ground 50. An opening is made in the back of the enclosure 21 to allow the conduit to pass from the interior of the hollow post 12 through to the interior cavity of enclosure 21. Underground utilities are routed through conduit 32 pathway of the base assembly 30 (see FIG. 4) and are connected to the 110V outdoor rated ground fault interrupter (GFI) outlet 22 housed inside enclosure 21. A multi-outlet surge and lightning protection device 23 is mounted inside enclosure 21 and is connected or plugged into GFI outlet 22, two power supplies 24A and 24B that can convert 110 AC to DC power ranging from 12 to 16 volts DC are mounted inside enclosure 21, the two power supplies 24A and 24B are connected to the multi-outlet surge and lightning protection device 23, wireless radio receiver 25 is connected to first power supply 24A and programmable event relay controller with timer 26 is connected to second power supply 24B.

With reference to FIGS. 1&2, post 12 has an exposed upright portion above the surface of the ground 50 and a second end configured to be anchored into portable container 31 with poured concrete 33 (see FIG. 4). The exposed above ground 50 upright portion of post 12 connects to a weather proof removable cap 14 to seal the top of the post to protect from environmental elements and to provide service entry access. At least one light 16A-D and at least one siren 18A-D can be positioned near the top of the exposed upright portion of post 12. The lights 16A-D and the sirens 18A-D can be connected to the programmable event relay controller with timer 26 with wiring routed through the interior of the hollow center of post 12. The receiver module 20 (see FIG. 3) can be connected to the post 12 above the surface of the ground 50. After poured concrete 33 has hardened, base assembly 30 can be buried a predetermined depth under the surface of the ground to secure the sentry pole 10 in an upright position on a variety of terrain.

With continued reference to FIGS. 1&2, the elongated body or post 12 is vertical and in an upright position relative to the ground 50. The sentry pole 10 can be considered substantially vertical or in an upright position after installation of the sentry pole 10 and burial of the base assembly 30 (see FIG. 4) a predetermined depth under the surface of the ground 50.

In FIG. 3, when the wireless radio receiver 25 receives a set of data from a remote sensor corresponding to a breach along a perimeter boundary, the wireless radio receiver 25 can send a second set of data to the programmable event relay controller with timer 26. The programmable event relay controller with timer 26 can generate a variety of predetermined timing sequences causing the lights 16A-D and the sirens 18A-D to activate. Once the predetermined time has elapsed, the lights 16A-D and sirens 18A-D return to silent standby operation.

The sentry pole 10, also forms a mounting platform for receiving any variety of security devices or additional accessories such as security cameras, battery backups, memory modules, communication modules or other equipment.

In use, along the perimeter boundary wall of a gated community, other perimeter boundary or restricted area, a predetermined number of the sentry pole 10 devices are installed based upon the coverage desired for the distance and shape of the perimeter boundary. When a remote sensor detects a perimeter breach, the remote sensor sends a signal that is received by wireless radio receiver 25 which causes the programmable event relay controller with timer 26 to generate a variety of predetermined timing sequences that cause lights 16A-D and sirens 18A-D to activate. The predetermined timing sequence can be customized based on the application and can provide a variety of programming including but not limited to activation of lights 16A-D only, activation of sirens 18A-D only, activation of both lights 16A-D and sirens 18A-D, activation of lights 16A-D first followed by activation of sirens 18A-D, activation of sirens 18A-D first followed by activation of lights 16A-D, activation of lights 16A-D only based on predetermined times of day such as evening hours only or any combination thereof. The timing sequence can also be customized so that the lights 16A-D and sirens 18A-D can remain activated for a predetermined length of time before returning to standby operation.

In one example, the sentry pole 10 can receive signals from a remote sensor that is part of a perimeter beam and laser detection system. When a perimeter security beam or laser detects an intruder, the remote sensor of the perimeter security beam or laser equipment sends a signal or data corresponding to a breach along a perimeter boundary. That remote signal can be acquired by the wireless radio receiver 25. The wireless radio receiver 25 activates the programmable event relay controller with timer 26 which can generate a variety of predetermined timing sequences that can activate the lights 16A-D and the sirens 18A-D for the predetermined time duration. Activation of the lights 16A-D and sirens 18A-D would notify the intruder that they have been detected for purposes of scaring them away before a crime is committed. After the predetermined amount of time has elapsed, the programmable event relay controller with timer 26 returns the lights 16A-D and the sirens 18A-D to standby operation.

The sentry pole 10, thereby forms an accessory part that can be added to a perimeter security system or other alarm system. The sentry pole 10 displays audible and visible signaling through the use of sound and light sources to deter crime by alerting an intruder that they have been detected near a point of entry along a perimeter boundary for purposes of scaring them away before a crime is committed.

The above described embodiments of the present invention are merely descriptive of its principles and are not to be considered limiting. The scope of the present invention instead shall be determined from the scope of the following claims and their equivalents, rather than by the examples given.

What is claimed is:

1. A signaling pole assembly for purposes of displaying audible and visible notifications through the use of at least one siren and at least one light to deter crime by alerting an intruder that they have been detected near a point of entry along a perimeter boundary, the signaling pole assembly comprising:

an elongated body that is rigid and hollow;

a base assembly to be buried underground for quick deployment on a variety of terrain, said base assembly comprising a portable container for advance assembly and redeployment, conduit for providing concealed access to underground utilities and poured concrete for securing said elongated body inside said portable container and;

a removable cap located at the top of an exposed upright portion of the elongated body, opposite said base assembly for service entry access and to protect from environmental elements and;

the at least one light positioned near the top of the exposed upright portion of said elongated body for providing the visible notification;

the at least one siren positioned near the top of the exposed upright portion of said elongated body for providing the audible notification;

at least one receiver module positioned on said elongated body above ground, comprising circuitry configured for receiving signals when a remote sensor has been triggered causing the at least one light and the at least one siren to activate and then return to standby operation after a predetermined amount of time has elapsed;

thereby forming the signaling pole assembly that provides the audible and visible notifications through the use of the at least one siren and the at least one light for purposes of deterring crime.

2. The signaling pole assembly of claim 1, wherein said ad least one receiver module further comprising a weatherproof enclosure made of hard material to shield components inside the enclosure, a 110V outdoor rated ground fault interrupter outlet, a surge and lightning protection device, a plurality of power supplies, a wireless radio receiver and a programmable event relay controller with timer.

3. The signaling pole assembly of claim 1, wherein said at least one receiver module is configured to generate a predetermined timing sequence causing the at least one light and the at least one siren to activate when the remote sensor has been triggered.

4. The signaling pole assembly of claim 1, wherein said at least one receiver module is configured to return the at least one light and the at least one siren to the standby operation when the predetermined amount of time has elapsed.

5. The signaling pole assembly of claim 1, wherein said at least one receiver module is in wireless communication with the remote sensor.

6. The signaling pole assembly of claim 1, wherein said at least one siren comprises an annunciator siren that sounds the audible notification to vacate the area or other verbal message.

7. The signaling pole assembly of claim 1, wherein said at least one light comprises a red and a blue light to simulate police lights.

8. The signaling pole assembly of claim 1, wherein said signaling pole assembly comprises a mounting platform for receiving any variety of security devices attached thereto.

9. The signaling pole assembly of claim 1, wherein said portable container consists of a five-gallon bucket or pail.

10. A method for displaying the audible and visible notifications through the use of the signaling pole assembly as defined in claim 1 to deter crime by alerting the intruder that they have been detected near the point of entry along the perimeter boundary, the method comprising:

acquiring a first set of data from the remote sensor, the first set of data corresponding to a breach along the perimeter boundary;

receiving the first set of data at a wireless radio receiver of the at least one receiver module and sending a second set of data to a programmable event relay controller with timer;

generating a timing sequence of a variety of predetermined timing sequences at the programmable event relay controller with timer after receiving the second set of data from the wireless radio receiver;

activating the at least one light and the at least one siren for the predetermined amount of time according to the timing sequence generated at the programmable event relay controller with timer; and returning the at least one light and the at least one siren to the standby operation after completing the predetermined amount of time.

* * * * *